US007298228B2

(12) United States Patent
Sievenpiper

(10) Patent No.: US 7,298,228 B2
(45) **Date of Patent: *Nov. 20, 2007**

(54) SINGLE-POLE MULTI-THROW SWITCH HAVING LOW PARASITIC REACTANCE, AND AN ANTENNA INCORPORATING THE SAME

(75) Inventor: Daniel F. Sievenpiper, Los Angeles, CA (US)

(73) Assignee: HRL Laboratories, LLC, Malibu, CA (US)

( * ) Notice: Subject to any disclaimer, the term of this patent is extended or adjusted under 35 U.S.C. 154(b) by 503 days.

This patent is subject to a terminal disclaimer.

(21) Appl. No.: 10/436,753

(22) Filed: May 12, 2003

(65) Prior Publication Data

US 2003/0227351 A1 Dec. 11, 2003

Related U.S. Application Data

(60) Provisional application No. 60/381,099, filed on May 15, 2002.

(51) Int. Cl.
*H01P 1/10* (2006.01)
*H01Q 21/00* (2006.01)

(52) U.S. Cl. ..... 333/101; 333/105; 343/844

(58) Field of Classification Search ..... 333/103, 333/105, 262, 101; 343/844
See application file for complete search history.

(56) References Cited

U.S. PATENT DOCUMENTS

| | | | | |
|---|---|---|---|---|
| 3,267,480 | A | 8/1966 | Lerner | 343/911 |
| 3,560,978 | A | 2/1971 | Himmel et al. | 343/106 |
| 3,810,183 | A | 5/1974 | Krutsinger et al. | 343/708 |
| 3,961,333 | A | 6/1976 | Purinton | 343/872 |
| 4,045,800 | A | 8/1977 | Tang et al. | 343/854 |
| 4,051,477 | A | 9/1977 | Murphy et al. | 343/700 MS |
| 4,119,972 | A | 10/1978 | Fletcher et al. | 343/844 |
| 4,123,759 | A | 10/1978 | Hines et al. | 342/374 |
| 4,124,852 | A | 11/1978 | Steudel | 342/374 |
| 4,127,586 | A | 11/1978 | Rody et al. | 548/260 |
| 4,150,382 | A | 4/1979 | King | 343/754 |
| 4,173,759 | A | 11/1979 | Bakhru | 342/382 |
| 4,189,733 | A | 2/1980 | Malm | 342/368 |
| 4,217,587 | A | 8/1980 | Jacomini | 342/372 |

(Continued)

FOREIGN PATENT DOCUMENTS

DE 196 00 609 A1 4/1997

(Continued)

OTHER PUBLICATIONS

Bialkowski, M.E., et al., "Electronically Steered Antenna System for the Australian Mobilesat," *IEE Proc.-Microw. Antennas Propag.*, vol. 143, No. 4, pp. 347-352 (Aug. 1996).

(Continued)

*Primary Examiner*—Dean Takaoka
(74) *Attorney, Agent, or Firm*—Ladas & Parry

(57) ABSTRACT

A switch arrangement comprises a plurality of MEMS switches arranged on a substrate about a central point, each MEMS switch being disposed on a common imaginary circle centered on the central point. Additionally, and each MEMS switch is preferably spaced equidistantly along the circumference of the imaginary circle. Connections are provided for connecting a RF port of each one of the MEMS switches with the central point.

39 Claims, 8 Drawing Sheets

U.S. PATENT DOCUMENTS

| | | | | |
|---|---|---|---|---|
| 4,220,954 | A | 9/1980 | Marchand | 342/433 |
| 4,236,158 | A | 11/1980 | Daniel | 342/380 |
| 4,242,685 | A | 12/1980 | Sanford | 343/770 |
| 4,266,203 | A | 5/1981 | Saudreau et al. | 333/21 A |
| 4,308,541 | A | 12/1981 | Seidel et al. | 343/786 |
| 4,367,475 | A | 1/1983 | Schiavone | 343/767 |
| 4,370,659 | A | 1/1983 | Chu et al. | 343/772 |
| 4,387,377 | A | 6/1983 | Kandler | 343/756 |
| 4,395,713 | A | 7/1983 | Nelson et al. | 343/713 |
| 4,443,802 | A | 4/1984 | Mayes | 343/729 |
| 4,590,478 | A | 5/1986 | Powers et al. | 343/700 MS |
| 4,594,595 | A | 6/1986 | Struckman | 343/770 |
| 4,672,386 | A | 6/1987 | Wood | 343/770 |
| 4,684,953 | A | 8/1987 | Hall | 343/725 |
| 4,700,197 | A | 10/1987 | Milne | 343/837 |
| 4,730,192 | A * | 3/1988 | Overbury | 342/399 |
| 4,737,795 | A | 4/1988 | Nagy et al. | 343/712 |
| 4,749,966 | A | 6/1988 | Stern et al. | 333/1.1 |
| 4,760,402 | A | 7/1988 | Mizuno et al. | 343/713 |
| 4,782,346 | A | 11/1988 | Sharma | 343/795 |
| 4,803,494 | A | 2/1989 | Norris et al. | 343/770 |
| 4,821,040 | A | 4/1989 | Johnson et al. | 343/700 MS |
| 4,835,541 | A | 5/1989 | Johnson et al. | 343/713 |
| 4,843,400 | A | 6/1989 | Tsao et al. | 343/700 MS |
| 4,843,403 | A | 6/1989 | Lalezari et al. | 343/767 |
| 4,853,704 | A | 8/1989 | Diaz et al. | 343/767 |
| 4,903,033 | A | 2/1990 | Tsao et al. | 343/700 MS |
| 4,905,014 | A | 2/1990 | Gonzalez et al. | 343/909 |
| 4,916,457 | A | 4/1990 | Foy et al. | 343/770 |
| 4,922,263 | A | 5/1990 | Dubost et al. | 343/797 |
| 4,958,165 | A | 9/1990 | Axford et al. | 343/770 |
| 4,975,712 | A | 12/1990 | Chen | 343/754 |
| 5,021,795 | A | 6/1991 | Masiulis | 343/700 MS |
| 5,023,623 | A | 6/1991 | Kreinheder et al. | 343/725 |
| 5,070,340 | A | 12/1991 | Diaz | 343/767 |
| 5,081,466 | A | 1/1992 | Bitter, Jr. | 343/767 |
| 5,115,217 | A | 5/1992 | McGrath et al. | 333/246 |
| 5,146,235 | A | 9/1992 | Frese | 343/895 |
| 5,158,611 | A | 10/1992 | Ura et al. | 106/499 |
| 5,208,603 | A | 5/1993 | Yee | 343/909 |
| 5,218,374 | A | 6/1993 | Koert et al. | 343/789 |
| 5,235,343 | A | 8/1993 | Audren et al. | 343/816 |
| 5,268,696 | A | 12/1993 | Buck et al. | 342/372 |
| 5,268,701 | A | 12/1993 | Smith | 343/767 |
| 5,278,562 | A | 1/1994 | Martin et al. | 342/1 |
| 5,287,116 | A | 2/1994 | Iwasaki et al. | 343/700 MS |
| 5,287,118 | A | 2/1994 | Budd | 343/909 |
| 5,402,134 | A | 3/1995 | Miller et al. | 343/742 |
| 5,406,292 | A | 4/1995 | Schnetzer et al. | 343/700 MS |
| 5,519,408 | A | 5/1996 | Schnetzer | 343/767 |
| 5,525,954 | A | 6/1996 | Komazaki et al. | 333/219 |
| 5,531,018 | A | 7/1996 | Saia et al. | 29/622 |
| 5,532,709 | A | 7/1996 | Talty | 343/819 |
| 5,534,877 | A | 7/1996 | Sorbello et al. | 343/700 MS |
| 5,541,614 | A | 7/1996 | Lam et al. | 343/792.5 |
| 5,557,291 | A | 9/1996 | Chu et al. | 343/725 |
| 5,581,266 | A | 12/1996 | Peng et al. | 343/770 |
| 5,589,845 | A | 12/1996 | Yandrofski et al. | 343/909 |
| 5,598,172 | A | 1/1997 | Chekroun | 343/754 |
| 5,600,325 | A | 2/1997 | Whelan et al. | 342/13 |
| 5,611,940 | A | 3/1997 | Zettler | 73/514.16 |
| 5,619,365 | A | 4/1997 | Rhoads et al. | 359/248 |
| 5,619,366 | A | 4/1997 | Rhoads et al. | 359/248 |
| 5,621,571 | A | 4/1997 | Bantli et al. | 359/529 |
| 5,638,946 | A | 6/1997 | Zavracky | 200/181 |
| 5,644,319 | A | 7/1997 | Chen et al. | 343/702 |
| 5,694,134 | A | 12/1997 | Barnes | 343/700 MS |
| 5,721,194 | A | 2/1998 | Yandrofski et al. | 505/210 |
| 5,767,807 | A | 6/1998 | Pritchett | 342/374 |
| 5,808,527 | A | 9/1998 | De Los Santos | 333/205 |
| 5,815,818 | A | 9/1998 | Tanaka et al. | 455/522 |
| 5,874,915 | A | 2/1999 | Lee et al. | 342/375 |
| 5,892,485 | A | 4/1999 | Glabe et al. | 343/789 |
| 5,894,288 | A | 4/1999 | Lee et al. | 343/770 |
| 5,905,465 | A | 5/1999 | Olson et al. | 343/700 MS |
| 5,923,303 | A | 7/1999 | Schwengler et al. | 343/853 |
| 5,926,139 | A | 7/1999 | Korisch | 343/702 |
| 5,929,819 | A | 7/1999 | Grinberg | 343/754 |
| 5,943,016 | A | 8/1999 | Snyder, Jr. et al. | 343/700 MS |
| 5,945,951 | A | 8/1999 | Monte et al. | 343/700 MS |
| 5,949,382 | A | 9/1999 | Quan | 343/767 |
| 5,966,096 | A | 10/1999 | Brachat | 343/700 MS |
| 5,966,101 | A | 10/1999 | Haub et al. | 343/767 |
| 6,005,519 | A | 12/1999 | Burns | 343/700 MS |
| 6,005,521 | A | 12/1999 | Suguro et al. | 343/700 MS |
| 6,008,770 | A | 12/1999 | Sugawara | 343/767 |
| 6,016,125 | A | 1/2000 | Johansson | 343/702 |
| 6,028,561 | A | 2/2000 | Takei | 343/767 |
| 6,028,692 | A | 2/2000 | Rhoads et al. | 359/245 |
| 6,034,644 | A | 3/2000 | Okabe et al. | 343/767 |
| 6,034,655 | A | 3/2000 | You | 345/60 |
| 6,037,905 | A | 3/2000 | Koscica et al. | 343/701 |
| 6,040,803 | A | 3/2000 | Spall | 343/700 MS |
| 6,046,655 | A | 4/2000 | Cipolla | 333/137 |
| 6,046,659 | A | 4/2000 | Loo et al. | 333/362 |
| 6,054,659 | A | 4/2000 | Lee et al. | 200/181 |
| 6,061,025 | A | 5/2000 | Jackson et al. | 343/700 MS |
| 6,075,485 | A | 6/2000 | Lilly et al. | 343/700 MS |
| 6,081,235 | A | 6/2000 | Romanofsky et al. | 343/700 MS |
| 6,081,239 | A | 6/2000 | Sabet et al. | 343/753 |
| 6,097,263 | A | 8/2000 | Mueller et al. | 333/17.1 |
| 6,097,343 | A | 8/2000 | Goetz et al. | 343/708 |
| 6,118,406 | A | 9/2000 | Josypenko | 343/700 MS |
| 6,118,410 | A | 9/2000 | Nagy | 343/713 |
| 6,127,908 | A | 10/2000 | Bozler et al. | 333/246 |
| 6,150,989 | A | 11/2000 | Aubry | 343/767 |
| 6,154,176 | A | 11/2000 | Fathy et al. | 343/700 MS |
| 6,166,705 | A | 12/2000 | Mast et al. | 343/853 |
| 6,175,337 | B1 | 1/2001 | Jasper, Jr. et al. | 343/770 |
| 6,175,723 | B1 | 1/2001 | Rothwell, III | 455/63.1 |
| 6,188,369 | B1 | 2/2001 | Okabe et al. | 343/767 |
| 6,191,724 | B1 | 2/2001 | McEwan | 342/21 |
| 6,198,438 | B1 | 3/2001 | Herd et al. | 343/700 MS |
| 6,198,441 | B1 | 3/2001 | Okabe et al. | 343/702 |
| 6,204,819 | B1 | 3/2001 | Hayes et al. | 343/702 |
| 6,218,912 | B1 | 4/2001 | Mayer | 333/106 |
| 6,218,997 | B1 | 4/2001 | Lindenmeier et al. | 343/725 |
| 6,246,377 | B1 | 6/2001 | Aiello et al. | 343/700 |
| 6,252,473 | B1 | 6/2001 | Ando | 333/105 |
| 6,285,325 | B1 | 9/2001 | Nalbandian et al. | 343/700 MS |
| 6,307,519 | B1 | 10/2001 | Livingston et al. | 343/767 |
| 6,317,095 | B1 | 11/2001 | Teshirogi et al. | 343/785 |
| 6,323,826 | B1 | 11/2001 | Sievenpiper et al. | 343/909 |
| 6,331,257 | B1 | 12/2001 | Loo et al. | 216/13 |
| 6,337,668 | B1 * | 1/2002 | Ito et al. | 343/833 |
| 6,366,254 | B1 | 4/2002 | Sievenpiper et al. | 343/770 |
| 6,373,349 | B2 | 4/2002 | Gilbert | 333/126 |
| 6,380,895 | B1 | 4/2002 | Moren et al. | 343/700 MS |
| 6,388,631 | B1 | 5/2002 | Livingston et al. | 343/767 |
| 6,392,610 | B1 | 5/2002 | Braun et al. | 343/876 |
| 6,404,390 | B2 | 6/2002 | Sheen | 343/700 MS |
| 6,404,401 | B2 | 6/2002 | Gilbert et al. | 343/780 |
| 6,407,719 | B1 | 6/2002 | Ohira et al. | 343/893 |
| 6,417,807 | B1 | 7/2002 | Hsu et al. | 343/700 MS |
| 6,424,319 | B2 * | 7/2002 | Ebling et al. | 343/911 L |
| 6,426,722 | B1 | 7/2002 | Sievenpiper et al. | 343/700 MS |
| 6,440,767 | B1 | 8/2002 | Loo et al. | 438/52 |
| 6,469,673 | B2 | 10/2002 | Kaiponen | 343/703 |
| 6,473,362 | B1 | 10/2002 | Gabbay | 367/119 |
| 6,483,480 | B1 | 11/2002 | Sievenpiper et al. | 343/909 |
| 6,496,155 | B1 | 12/2002 | Sievenpiper et al. | 343/770 |
| 6,515,635 | B2 | 2/2003 | Chiang et al. | 343/834 |
| 6,518,931 | B1 | 2/2003 | Sievenpiper | 343/700 |

| | | | | |
|---|---|---|---|---|
| 6,525,695 | B2 | 2/2003 | McKinzie, III | 343/756 |
| 6,538,621 | B1 | 3/2003 | Sievenpiper et al. | 343/909 |
| 6,552,696 | B1 | 4/2003 | Sievenpiper et al. | 343/909 |
| 6,624,720 | B1 * | 9/2003 | Allison et al. | 333/105 |
| 6,642,889 | B1 * | 11/2003 | McGrath | 343/700 MS |
| 6,657,525 | B1 | 12/2003 | Dickens et al. | 335/78 |
| 6,741,207 | B1 * | 5/2004 | Allison et al. | 342/371 |
| 6,822,622 | B2 | 11/2004 | Crawford et al. | 343/909 |
| 6,864,848 | B2 | 3/2005 | Sievenpiper | 343/767 |
| 6,897,810 | B2 | 5/2005 | Dai et al. | 343/700 MS |
| 6,897,831 | B2 | 5/2005 | McKinzie et al. | 343/909 |
| 6,917,343 | B2 | 7/2005 | Sanchez et al. | 343/795 |
| 6,940,363 | B2 | 9/2005 | Zipper et al. | 333/103 |
| 2001/0035801 | A1 | 11/2001 | Gilbert | 333/126 |
| 2002/0036586 | A1 | 3/2002 | Gothard et al. | 342/374 |
| 2003/0122721 | A1 | 7/2003 | Sievenpiper | 343/767 |
| 2003/0193446 | A1 | 10/2003 | Chen | 343/893 |
| 2003/0222738 | A1 | 12/2003 | Brown et al. | 333/206 |
| 2003/0227351 | A1 | 12/2003 | Sievenpiper | 333/105 |
| 2004/0135649 | A1 | 7/2004 | Sievenpiper | 333/105 |
| 2004/0227583 | A1 | 11/2004 | Shaffner et al. | 333/32 |
| 2004/0227667 | A1 | 11/2004 | Sievenpiper | 343/700 MS |
| 2004/0227668 | A1 | 11/2004 | Sievenpiper | 343/700 MS |
| 2004/0227678 | A1 | 11/2004 | Sievenpiper | 343/702 |
| 2004/0263408 | A1 | 12/2004 | Sievenpiper et al. | 343/757 |
| 2005/0012667 | A1 | 1/2005 | Noujeim | 343/700 MS |

FOREIGN PATENT DOCUMENTS

| | | | |
|---|---|---|---|
| EP | 0 539 297 | | 4/1993 |
| EP | 1 158 605 | A1 | 11/2001 |
| FR | 2 785 476 | | 5/2000 |
| GB | 1145208 | | 3/1969 |
| GB | 2 281 662 | | 3/1995 |
| GB | 2 328 748 | | 3/1999 |
| JP | 61-260702 | | 11/1986 |
| WO | 94/00891 | | 1/1994 |
| WO | 96/29621 | | 9/1996 |
| WO | 98/21734 | | 5/1998 |
| WO | 99/50929 | | 10/1999 |
| WO | 00/44012 | | 7/2000 |
| WO | 01/31737 | | 5/2001 |
| WO | 01/73891 | A1 | 10/2001 |
| WO | 01/73893 | A1 | 10/2001 |
| WO | WO 03/098732 | A1 * | 11/2003 |

OTHER PUBLICATIONS

Balanis, C., "Aperture Antennas," *Antenna Theory, Analysis and Design*, 2nd Edition, Ch. 12, pp. 575-597 (1997).

Balanis, C., "Microstrip Antennas," *Antenna Theory, Analysis and Design*, 2nd Edition, Ch. 14, pp. 722-736 (1997).

Bradley, T.W., et al., "Development Of A Voltage-Variable Dielectric (VVD), Electronic Scan Antenna," *Radar 97*, Publication No. 449, pp. 383-385 (Oct. 1997).

Bushbeck, M.D., et al., "A Tuneable, Switchable Dielectric Grating," *IEEE Microwave and Guided Wave Letters*, vol. 3, No. 9, pp. 296-298 (Sep. 1993).

Chambers, B., et al., "Tunable Radar Absorbers Using Frequency Selective Surfaces," *11th International Conference on Antennas and Propagation*, Conference Publication No. 480, pp. 593-593 (Apr. 17-20, 2001).

Chang, T.K., et al., "Frequency Selective Surfaces on Biased Ferrite Substrates," *Electronics Letters*, vol. 30, No. 15, pp. 1193-1194 (Jul. 21, 1994).

Chen, P.W., et al., "Planar Double-Layer Leaky Wave Microstrip Antenna," *IEEE Transactions on Antennas and Propagation*, vol. 50, pp. 832-835 (2002).

Chen, Q., et al., "FDTD diakoptic design of a slot-loop antenna excited by a coplanar waveguide," *Proceedings of the 25th European Microwave Conference 1995*, vol. 2, Conf. 25, pp. 815-819 (Sep. 4, 1995).

Cognard, J., "Alignment of Nematic Liquid Crystals and Their Mixtures," *Mol. Cryst. Liq., Cryst. Suppl. 1*, pp. 1-74 (1982).

Doane, J.W., et al., "Field Controlled Light Scattering from Nematic Microdroplets," *Appl. Phys. Lett.*, vol. 48, pp. 269-271 (Jan. 1986).

Ellis, T.J., et al., "MM-Wave Tapered Slot Antennas on Micromachined Photonic Bandgap Dielectrics," *1996 IEEE MTT-S International Microwave Symposium Digest*, vol. 2, pp. 1157-1160 (1996).

Gianvittorio, J.P., et al., "Reconfigurable MEMS-enabled Frequency Selective Surfaces," *Electronics Letters*, vol. 38, No. 25, pp. 1627-1628 (Dec. 5, 2002).

Grbic, A., et al., "Experimental Verification of Backward Wave Radiation From A Negative Refractive Index Metamaterial," *Journal of Applied Physics*, vol. 92, No. 10, pp. 5930-5935 (Nov. 15, 2002).

Hu, C.N., et al., "Analysis and Design of Large Leaky-Mode Array Employing The Coupled-Mode Approach," *IEEE Transactions on Microwave Theory and Techniques*, vol. 49, No. 4, pp. 629-636 (Apr. 2001).

Jablonski, W., et al., "Microwave Schottky Diode With Beam-Lead Contact," *13th Conference on Microwaves, Radar and Wireless Communications*, MIKON-2000, vol. 2, pp. 678-681 (2001).

Jensen, M.A., et al., "EM Interaction of Handset Antennas and a Human in Personal Communications," *Proceedings of the IEEE*, vol. 83, No. 1, pp. 7-17 (Jan. 1995).

Jensen, M.A., et al., "Performance Analysis of Antennas for Handheld Transceivers Using FDTD," *IEEE Transactions on Antennas and Propagation*, vol. 42, No. 8, pp. 1106-1113 (Aug. 1994).

Lee, J.W., et al., "TM-Wave Reduction From Grooves In A Dielectric-Covered Ground Plane," *IEEE Transactions on Antennas and Propagation*, vol. 49, No. 1, pp. 104-105 (Jan. 2001).

Lima, A.C. de C., et al., "Tunable Frequency Selective Surfaces Using Liquid Substrates," *Electronics Letters*, vol. 30, No. 4, pp. 281-282 (Feb. 17, 1994).

Linardou, I., et al., "Twin Vivaldi Antenna Fed By Coplanar Waveguide," *Electronics Letters*, vol. 33, No. 22, pp. 1835-1837 (1997).

Malherbe, A., et al., "The Compensation of Step Discontinues in TEM-Mode Transmission Lines," *IEEE Transactions on Microwave Theory and Techniques*, vol. MTT-26, No. 11, pp. 883-885 (Nov. 1978).

Maruhashi, K., et al., "Design and Performance of a Ka-Band Monolithic Phase Shifter Utilizing Nonresonant FET Switches," *IEEE Transactions on Microwave Theory and Techniques*, vol. 48, No. 8, pp. 1313-1317 (Aug. 2000).

Oak, A.C., et al., "A Varactor Tuned 16-Element MESFET Grid Oscillator," *Antennas and Propagation Society International Symposium*, pp. 1296-1299 (1995).

Perini, P., et al., "Angle and Space Diversity Comparisons in Different Mobile Radio Environments," *IEEE Transactions on Antennas and Propagation*, vol. 46, No. 6, pp. 764-775 (Jun. 1998).

Ramo, S., et al., *Fields and Waves in Communication Electronics*, 3rd Edition, Sections 9.8-9.11, pp. 476-487 (1994).

Rebeiz, G.M., et al., "RF MEMS Switches and Switch Circuits," *IEEE Microwave Magazine*, pp. 59-71 (Dec. 2001).

Schaffner, J., et al., "Reconfigurable Aperture Antennas Using RF MEMS Switches for Multi-Octave Tunability and Beam Steering," *IEEE Antennas and Propagation Society International Symposium*, 2000 Digest, vol. 1 of 4, pp. 321-324 (Jul. 16, 2000).

Semouchkina, E., et al., "Numerical Modeling and Experimental Study of A Novel Leaky Wave Antenna," *Antennas and Propagation Society*, IEEE International Symposium, vol. 4, pp. 234-237 (2001).

Stevenpiper, D., et al., "Eliminating Surface Currents With Metallodielectric Photonic Crystals," *1998 MTT-S International Microwave Symposium Digest*, vol. 2, pp. 663-666 (Jun. 7, 1998).

Sievenpiper, D., et al., "High-Impedance Electromagnetic Surfaces with a Forbidden Frequency Band," *IEEE Transactions on Microwave Theory and Techniques*, vol. 47, No. 11, pp. 2059-2074 (Nov. 1999).

Sievenpiper, D., et al., "High-Impedance Electromagnetic Surfaces," *Ph.D. Dissertation*, Dept. Of Electrical Engineering, University of California, Los Angeles, CA, 1999.

Sievenpiper, D., et al., "Low-Profile, Four Sector Diversity Antenna On High-Impedance Ground Plane," *Electronics Letters*, vol. 36, No. 16, pp. 1343-1345 (Aug. 3, 2000).

Sor, J., et al., "A Reconfigurable Leaky-Wave/Patch Microstrip Aperture For Phased-Array Applications," *IEEE Transactions on Microwave Theory and Techniques*, vol. 50, No. 8, pp. 1877-1884 (Aug. 2002).

Vaughan, Mark J., et al., "InP-Based 28 Ghz Integrated Antennas for Point-to-Multipoint Distribution," *IEEE*, pp. 75-84 (1995).

Vaughan, R., "Spaced Directive Antennas for Mobile Communications by the Fourier Transform Method," *IEEE Transactions on Antennas and Propagation*, vol. 48, No. 7, pp. 10252-1032 (Jul. 2000).

Wang, C.J., et al., "Two-Dimensional Scanning Leaky-Wave Antenna by Utilizing the Phased Array," *IEEE Microwave and Wireless Components Letters*, vol. 12, No. 8, pp. 311-313, (Aug. 2002).

Wu, S.T., et al., "High Birefringence and Wide Nematic Range Bis-Tolane Liquid Crystals," *Appl. Phys. Lett.*, vol. 74, No. 5, pp. 344-346 (Jan. 18, 1999).

Yang, Hung-Yu David, et al., "Theory of Line-Source Radiation From A Metal- Strip Grating Dielectric-Slab Structure," *IEEE Transactions on Antennas and Propagation*, vol. 48, No. 4, pp. 556-564 (2000).

Yashchyshyn, Y., et al., The Leaky-Wave Antenna With Ferroelectric Substrate, *14th International Conference on Microwaves, Radar and Wireless Communications*, MIKON-2002, vol. 2, pp. 218-221 (2002).

U.S. Appl. No. 10/944,032, filed Sep. 17, 2004, Sievenpiper.

Brown, W.C., "The History of Power Transmission by Radio Waves," *IEEE Transactions on Microwave Theory and Techniques*, vol. MTT-32, No. 9, pp. 1230-1242 (Sep. 1984).

Fay, P., et al., "High-Performance Antimonide-Based Heterostructure Backward Diodes for Millimeter-Wave Detection," *IEEE Electron Device Letters*, vol. 23, No. 10, pp. 585-587 (Oct. 2002).

Gold, S.H.,et al., "Review of High-Power Microwave Source Research," *Rev. Sci. Instrum.*, vol. 68, No. 11, pp. 3945-3974 (Nov. 1997).

Koert, P., et al., "Millimeter Wave Technology for Space Power Beaming," *IEEE Transactions on Microwave Theory and Techniques*, vol. 40, No. 6, pp. 1251-1258 (Jun. 1992).

Lezec, H.J., et al., "Beaming Light from a Subwavelength Aperture," *Science*, vol. 297, pp. 820-821 (Aug. 2, 2002).

McSpadden, J.O.,et al., "Design and Experiments of a High-Conversion-Efficiency 5.8-GHz Rectenna," *IEEE Transactions on Microwave Theory and Techniques*, vol. 46, No. 12, pp. 2053-2060 (Dec. 1998).

Schulman, J.N., et al., "Sb-Heterostructure Interband Backward Diodes,"*IEEE Electron Device Letters*, vol. 21, No. 7, pp. 353-355 (Jul. 2000).

Sievenpiper, D., et al., "Beam Steering Microwave Reflector Based On Electrically Tunable Impedance Surface," *Electronics Letters*, vol. 38, No. 21, pp. 1237-1238 (Oct. 1, 2002).

Sievenpiper, D.F., et al., "Two-Dimensional Beam Steering Using an Electrically Tunable Impedance Surface," *IEEE Transactions on Antennas and Propagation*, vol. 51, No. 10, pp. 2713-2722 (Oct. 2003).

Strasser, B., et al., "5.8-GHz Circularly Polarized Rectifying Antenna for Wireless Microwave Power Transmission," *IEEE Transactions on Microwave Theory and Techniques*, vol. 50, No. 8, pp. 1870-1876 (Aug. 2002).

Swartz, N., "Ready for CDMA 2000 1xEV-Do?," *Wireless Review*, 2 pages total (Oct. 29, 2001).

Yang, F.R., et al., "A Uniplanar Compact Photonic-Bandgap (UC-PBG) Structure and Its Applications for Microwave Circuits," *IEEE Transactions on Microwave Theory and Techniques*, vol. 47, No. 8, pp. 1509-1514 (Aug. 1999).

* cited by examiner

SINGLE-POLE MULTI-THROW SWITCH HAVING LOW PARASITIC REACTANCE, AND AN ANTENNA INCORPORATING THE SAME

CROSS REFERENCE TO RELATED APPLICATIONS

This application claims the benefit of U.S. Provisional Patent Application No. 60/381,099 filed on May 15, 2002, which application is incorporated herein by reference.

TECHNICAL FIELD

This invention relates to single-pole, multi-throw switches that are built using single-pole, single-throw devices combined in a hybrid circuit. The switches of this invention are symmetrically located around a central point which is a vertical via in a multi layer printed circuit board.

BACKGROUND OF THE INVENTION AND CROSS REFERENCE TO RELATED APPLICATIONS

This application incorporates by reference the disclosure of U.S. Provisional Patent Application Ser. No. 60/470,026 filed May 12, 2003 and entitled "RE MEMS Switch with Integrated Impedance Matching Structure".

In one aspect, this invention addresses several problems with existing single-pole, multi-throw switches built using single-pole, single-throw devices preferably combined in a switch matrix. According to this aspect of the invention, the switches are symmetrically located around a central point which is preferably a vertical via in a multi layer printed circuit board. In this way, a maximum number of switches can be located around the common port with a minimum amount of separation. This leads to the lowest possible parasitic reactance, and gives the circuit the greatest possible frequency response. Furthermore, any residual parasitic reactance can be matched by a single element on the common port, so that all ports will have the same frequency response. This patent describes a 1×4 switch, but the concept may be extended to a 1×6 switch or to a 1×8 switch or a switch with even greater fan out (1×N). Also, such a switch can be integrated with an antenna array for the purpose of producing a switched beam diversity antenna.

The switch arrangement disclosed herein can be conveniently used with a Vivaldi Cloverleaf Antenna to determine which antenna of the Vivaldi Cloverleaf Antenna is active. U.S. patent application Ser. No. 09/525,832 entitled "Vivaldi Cloverleaf Antenna" filed Mar. 12, 2000, the disclosure of which is hereby incorporated herein by this reference, teaches how Vivaldi Cloverleaf Antennas may be made.

The present invention has a number of possible applications and uses. As a basic building block in any communication system, and in microwave systems in general, a single-pole, multi-throw radio frequency switch has numerous applications. As communication systems get increasingly complicated, and they require diversity antennas, reconfigurable receivers, and space time processing, the need for more sophisticated radio frequency components will grow. These advanced communications systems will need single-pole multi-throw switches having low parasitic reactance. Such switches will be used, for example, in connection with the antenna systems of these communication systems.

The prior art includes the following:

(1) M. Ando, "Polyhedral Shaped Redundant Coaxial Switch", U.S. Pat. No. 6,252,473 issued Jun. 26, 2001 and assigned to Hughes Electronics Corporation. This patent describes a waveguide switch using bulk mechanical actuators.

(2) B. Mayer, "Microwave Switch with Grooves for Isolation of the Passages", U.S. Pat. No. 6,218,912 issued Apr. 17, 2001 and assigned to Robert Bosch GmbH. This patent describes a waveguide switch with a mechanical rotor structure.

Neither of the patents noted above address issues that are particular to the needs of a single-pole multi-throw switch of the type disclosed herein. Although they are of a radial design, they are built using a conventional waveguide rather than (i) MEM devices and (ii) microstrips. It is not obvious that a radial design could be used for a MEM device switch and/or a microstrip switch because the necessary vertical through-ground vias are not commonly used in microstrip circuits. Furthermore, the numerous examples of microstrip switches available in the commercial marketplace do not directly apply to this invention because they typically use PIN diodes or FET switches, which carry certain requirements for the biasing circuit that dictate the geometry and which are not convenient for use in a radial design.

There is a need for single-pole, multi-throw switches as a general building block for radio frequency communication systems. One means of providing such devices that have the performance required for modern Radio Frequency (RF) systems is to use RF Micro Electro-Mechanical System (MEMS) switches. One solution to this problem would be to simply build a 1×N monolithic MEMS switch on a single substrate. However, there may be situations in which this is not possible, or when one cannot achieve the required characteristics in a monolithic solution, such as a large fan-out number for example. In these situations, a hybrid approach should be used.

There are numerous ways to assemble single-pole, single-throw RF MEMS switches on a microwave substrate, along with RF lines to create the desired switching circuit. Possibly the most convenient way is shown in FIG. 1. A common port, represented here as a microstrip line 5, ends at a point 6 near which several RF MEMS switches 10-1 through 10-4 are clustered. RF MEMS switches 10-1 through 10-4 are preferably spaced equidistantly from a centerline of microstrip 5 and laterally on each side of it. Ports 1, 2, 3, and 4 then spread out from this central point 6, with each port being addressed by a single MEMS switch 10. The substrate, of which only a portion is shown, is represented by element 12. By closing one of the switches (for example, switch 10-4), and opening all of the others (for example, switches 10-1 through 10-3), RF energy can be directed from the common port provided by microstrip line 5 to the chosen selectable port (port 4 in this example) with very low loss. This switching circuit will also demonstrate high isolation between the common port and the three open ports, as well as high isolation between each of the selectable ports.

While the design depicted by FIG. 1 is believed to be novel, it has several flaws. Ideally, all four MEMS devices 10-1 through 10-4 should be clustered as close as reasonably possible around a single point 6. In FIG. 1, note that switches 10 have different spacings from end point 6. When the switches 10 are separated by a length of transmission line, as is the case in FIG. 1, that length of transmission line will then serve as a parasitic reactance to some of the ports. For example, in FIG. 1, the length or portion of transmission line designated by the letter "L" appears as an open microstrip stub to ports 1 and 2. This length L of microstrip 6 is referred to as a "stub" in the antenna art and it affects the impedance of the circuit in which it appears. The effect, in this embodiment, is likely to be undesirable. Unfortunately, the second pair of ports 3, 4 likely may not be brought any closer to the first pair 1, 2, because this would cause unwanted coupling between the closely spaced sections of microstrip line that would result. Furthermore, if one wanted to compensate for the parasitic reactance caused by the microstrip stub, one would need to separately tune each of the lines because they do not all see the same reactance. There may not be space on the top side of the circuit to allow a separate tuning element for each of the selectable ports, and still allow room for the DC bias lines and the RF signal lines.

BRIEF DESCRIPTION OF THE PRESENT INVENTION

FIG. 1 depicts a rather straightforward way of combining single-pole, single-throw RF MEMS switches into a single-pole, multi-throw hybrid design; however, the preferred designs are described with reference to the remaining figures.

In one aspect, the invention provides a switch arrangement comprising a plurality of MEMS switches arranged on a substrate about a central point, each MEMS switch being disposed on a common imaginary circle centered on said central point, and each MEMS switch being spaced equidistantly along the circumference of said imaginary circle; and connections for connecting a RF port of each one of said MEMS switches with said central point.

In another aspect, the invention provides a method of making a switch arrangement comprising: disposing a plurality of MEMS switches on a substrate in a circular pattern about a point; disposing a plurality of RF lines disposed in a radial pattern relative to said point on said substrate; and connecting said plurality of RF strip lines to a common junction point at said point on said substrate via said plurality of MEMS switches whereby operation of a one of said plurality of MEMS switches couples a one of said plurality of RF strip lines to said common junction.

DETAILED DESCRIPTION

Figure 1:
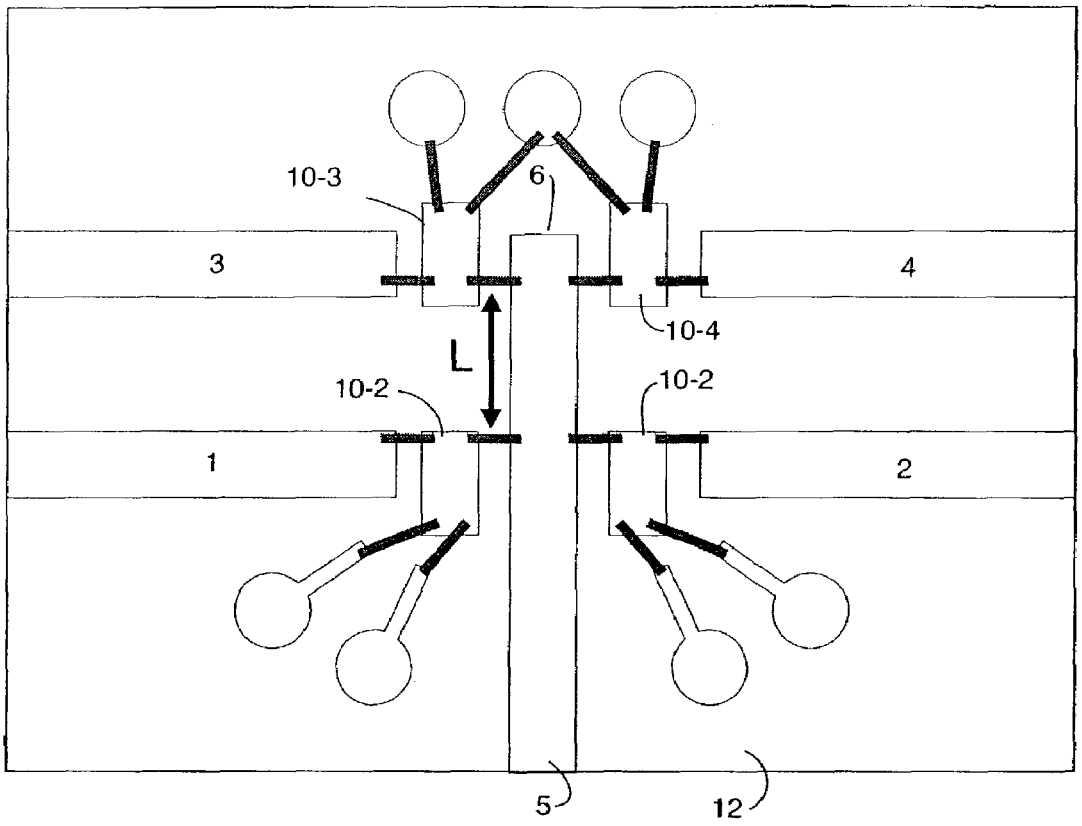
FIG. 1 depicts one technique for combining single-pole, single-throw RF MEMS switches into a single-pole, multi-throw hybrid design.
Figure 2A:
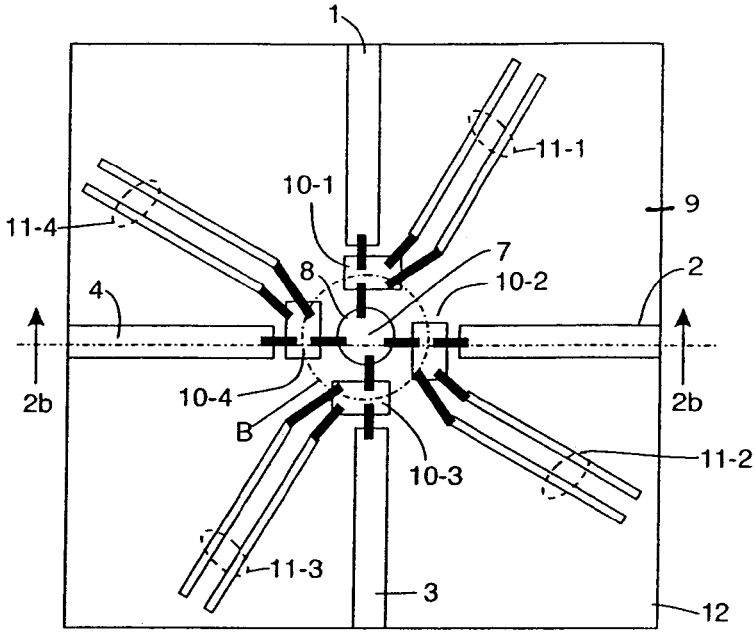
FIGS. 2*a* and 2*b* are top and side elevation views of one embodiment of the present invention.
Figure 2B:
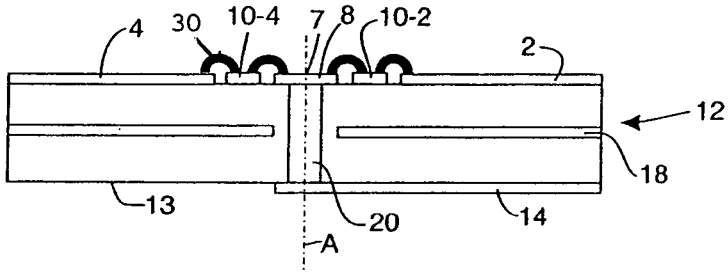

Recall FIG. 1 and the fact that this design poses a number of problems in terms of the impedances seen from the common port of the microstrip line 6 when the various ports 1-4 are switched on. One solution to this problem is shown in FIGS. 2*a* and 2*b*. The structure of FIGS. 2*a* and 2*b* preferably consists of a multi-layer printed circuit board 12, on which a common RF line 14 is formed on the bottom or back side 13 of the board 12, and is fed through a ground plane 18 by a metal plated via 20 to a central point 7 in the center of a 1×4 switch matrix of switches 10-1 through 10-4, which switches may be made as a hybrid on a common substrate (not shown) or which may be individually attached to surface 9. Switches 10-1 through 10-4 comprise a set of RF MEMS switches 10 (the numeral 10 when used without a dash and another numeral is used herein to refer to these RE MEMS switches in general as opposed to a particular switch). As will be seen, the number of switches 10 in the set can be greater than four, if desired.

RF MEMS switches 10 are positioned around common point 7, preferably in a radial geometry as shown. The benefit of this geometry is that each of the selectable ports 1-4 sees the same RF environment (including the same impedance) by utilizing the same local geometry which is preferably only varied by rotation about an axis "A" defined through common point 7. Therefore, each of the ports 1-4 should have the same RF performance (or, at least, nearly identical RF performances to each other). Furthermore, since this geometry permits the MEMS devices 10 to be clustered as closely as possible around common point 7, parasitic reactance should be minimized. Moreover, for the case of a 1×4 switch matrix, control line pairs 11 can be arranged at right angles to each other, resulting in very low coupling between them. This embodiment has four ports, but, as will be seen, this basic design can be modified to provide a greater (or lesser) number of ports.

The MEMS switches 10 are preferably disposed in a circular arrangement around central point 7 on substrate 12. Note that the switches 10 lie on a circular arrangement as indicated by the circular line identified by the letter B. Note also that the switches are preferably arranged equidistantly along the circumference of the circular line identified by the letter B. The MEMS switches 10 can be placed individually directly on surface 9 of the circuit board 12 or they may be formed on a small substrate (not shown) as a switch hybrid, which is in turn mounted on surface 9.

Via 20 preferably has a pad 8 on the top surface of the printed circuit board 12 to which the MEMS switches 10 can be wired, for example, using ball bonding techniques. The switches 10 are also wired to the control lines pairs 11 and to the ports 1-4.

In FIG. 2*a* common port 7 is fed from the underside of the ground plane through a vertical metal plated via 20 to the top side of the board 12 where it terminates at central point 7. MEMS switches 10 are radially clustered around this central point. The centers of the MEMS switches 10 are preferably spaced a common distance (a common radius) away from an axis A of the via 20. This allows a large number of switches 10 to be fit into a small area, yet allows the coupling between the ports to be minimized. In the particular case of the 1×4 switch, with MEMS switches 10-1-10-4, the coupling is further minimized by the fact that the RF microstrip lines directed to ports 1-4 are disposed at right angles to each other. The substrate 12 of this structure preferably is a multi-layer microwave substrate with a buried ground plane 18.

The RF microstrip lines coupling to ports 1-4 may form the driven elements of an antenna structure, for example, or may be coupled to antenna elements. Such elements may be used for sending and/or receiving RF signals.

Figure 3A:
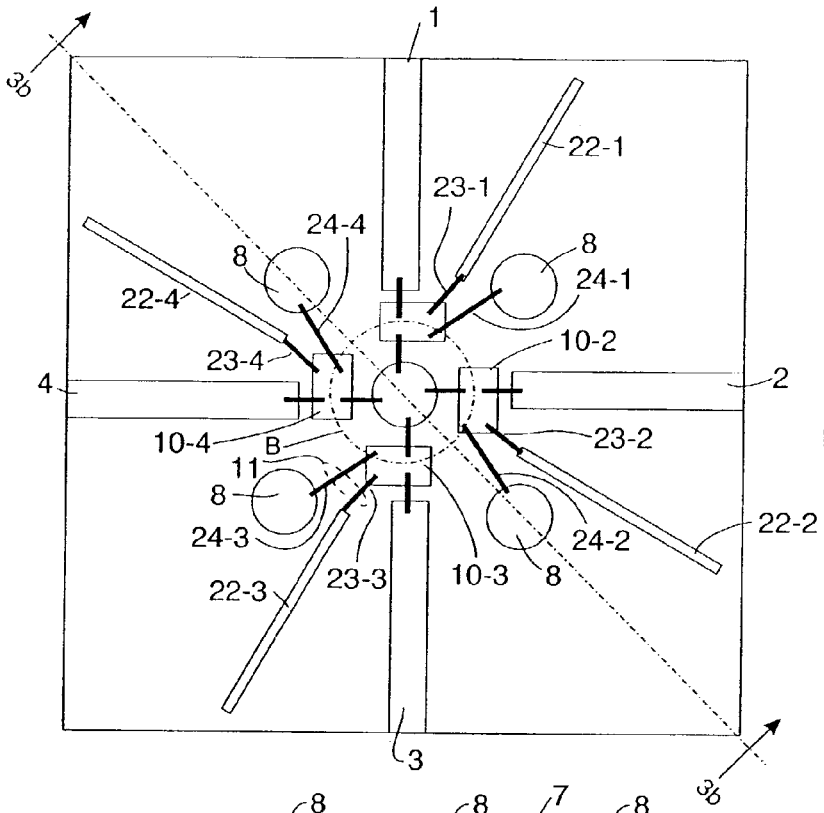
FIGS. 3*a* and 3*b* are top and side elevation views of another embodiment of the present invention.
Figure 3B:
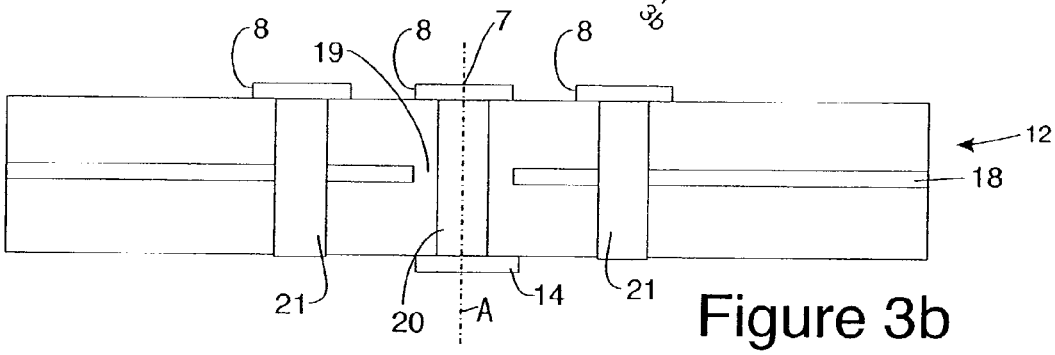

FIGS. 3*a* and 3*b* show another embodiment of the present invention, in which some of the DC bias lines are implemented as vias 21 which connect with the buried ground plane 18 in substrate 12. The vias 21 may have pads 8 formed on their top surfaces in order to facilitate connecting the ground connections on the MEMS switches 10 thereto. Since each bias line pair 11 consists of a ground line 24 and a signal or control line 23, each of the ground lines 24-1-24-4, may be tied to the RF ground plane 18, with no loss of performance, by means of vias 21. This results in fewer external connections to the circuit because only one DC control connection 23-1-23-4 is needed for each switch 10-1-10-4, which is half as many total connections compared with the embodiment of FIGS. 2*a* and 2*b*.

Figure 4:
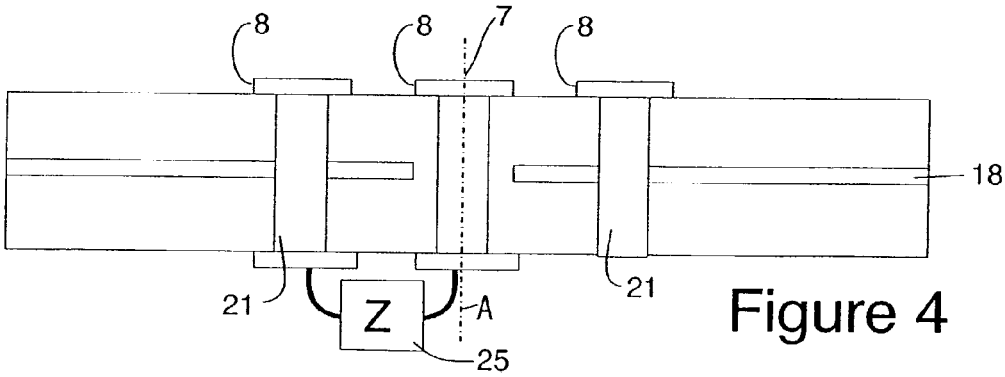
FIG. 4 shows a modification to the embodiment of FIGS. 3*a* and 3*b;*

An additional possible advantage of the geometry of FIGS. 3*a* and 3*c* is shown in FIG. 4. A feed-through via 20 such as that used for the common port 7 can sometimes have its own parasitic reactance. By providing a complementary reactance Z as an external lumped element 25, one may optimize the RF match of the circuit. In FIG. 4 the reactance Z couples via 20 to ground using one of the vias 21 coupled to ground plane 18. Since the impedance match is done on the central port 7, and all other ports are symmetrical, the same matching structure Z will work for all of the ports. This lumped element solution is one example of a matching structure, and others will be apparent to those skilled in the art of RF design. The ground connections of the MEMS switches 10 are wired to metal plated vias 21 directly or to their associated pads 8, either of which is in electrical communication with the buried ground plane 18. Note that the via 20 that provides the central RF port passes through a hole or opening 19 in the ground plane 18, while the vias 21 contact the ground plane 18.

As in the case of FIGS. 2*a* and 2*b*, the plurality of MEMS switch devices 10-1 10-4 of FIGS. 3*a*, 3*b* and 4 are arranged on substrate 12 about a vertical axis A through the substrate, each switch 10 being disposed in a circular arrangement centered on axis A (central point 7) with each switch 10 being preferably spaced equidistantly along the circumference of the imaginary circle B defining the circular arrangement. Thus, the MEMS switches 10 are preferably disposed in a circular arrangement around central point 7 on substrate 12. Note that the switches 10 lie on indicated by the circular line identified by the letter B. Note also that the switches are preferably arranged equidistantly along the circumference of the circular line identified by the letter B.

In FIGS. 2*a* and 3*a* the DC control lines 11 and 22 are depicted as being thinner than are the RE lines 14. If the DC lines are much thinner than the RE lines, they will have a higher impedance and coupling with the RF lines will be thereby reduced. While the percentage by which the DC are made thinner than the RE lines is somewhat a matter of tradeoffs, it is believed their width should preferably be about 25% of the width of the RE lines or less. The DC lines should be separated by at least one RE line width from the RE lines to reduce unwanted coupling. The MEMS switches may be wired to their RE lines, DC control lines, ground pads or lines by means of wires 30 bonded to the respective switches 10 and their various lines and/or pads.

Figure 5A:
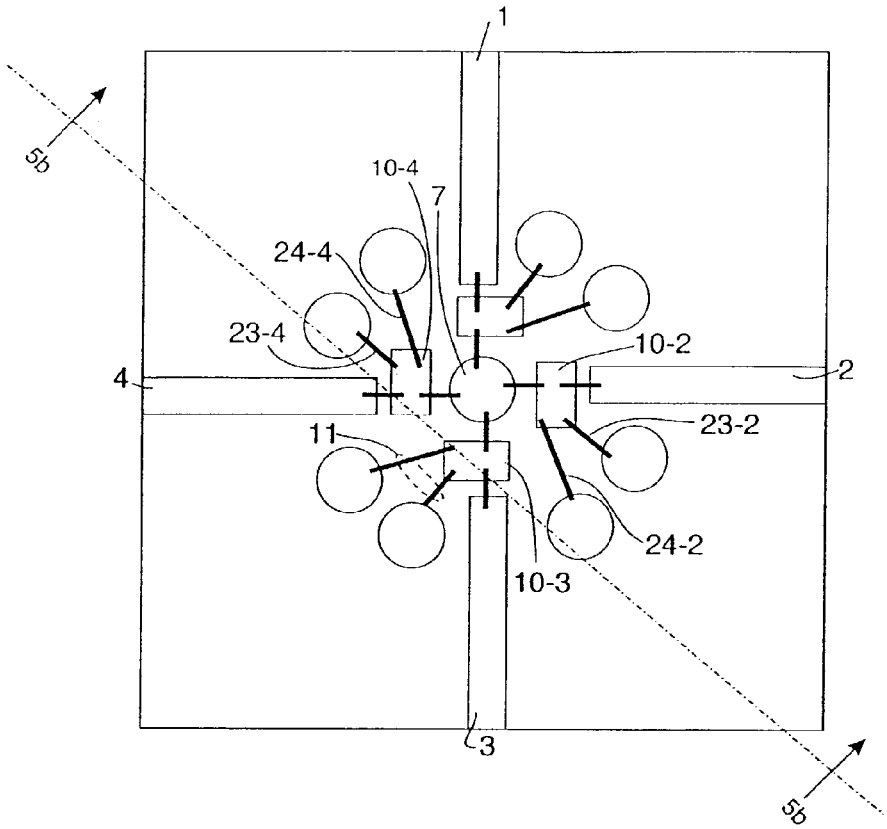
FIGS. 5*a* and 5*b* are top and side elevation views of yet another embodiment of the present invention.
Figure 5B:
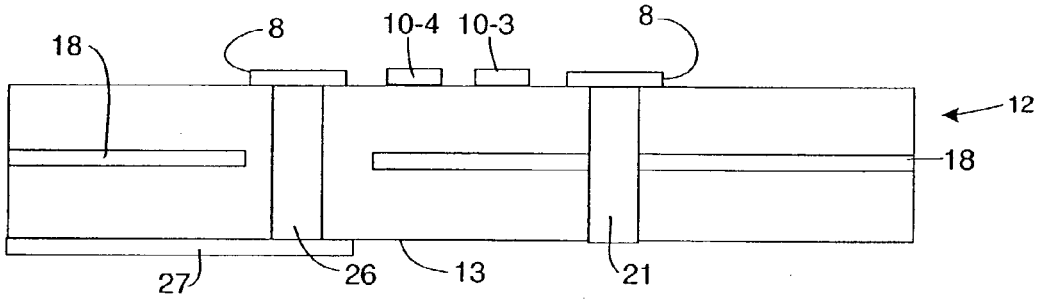

Yet another embodiment of this structure is shown in FIGS. 5*a* and 5*b*. In this embodiment, both the DC bias switch control lines 23, 24 associated with each switch 10 are fed through vertical metal plated vias 21, 26. For each switch 10, one of the lines (line 24) is grounded by means of via 21 contacting ground plane 18 and the other line (line 23) is connected, by means of a via 26 through a hole in the ground plane 18, to a trace 27 on the back side of the board 12 which functions as a MEMS switch 10 control line. This reduces clutter (lines which do not directly assist the RF capabilities of the switch arrangement) on the front of the board, and can allow for more complex switching circuits and for reduced coupling between the RF lines and the DC bias lines 11.

In the embodiment of FIGS. 5*a* and 5*b*, all of the DC bias lines 11 pass through metal plated vias 21, 26. Half of them contact the ground plane 18 and the other half pass through the ground plane to contact traces 27 on the bottom or back side 13 of the board 12.

Several geometries have been described which are based on a common theme of a radial switching structure, with discrete RF MEMS devices 10 assembled around a common input port 7 of microstrip line 14, and routing RF energy to one of several output ports (for example, ports 1-4 in a four port embodiment).

Figure 6A:
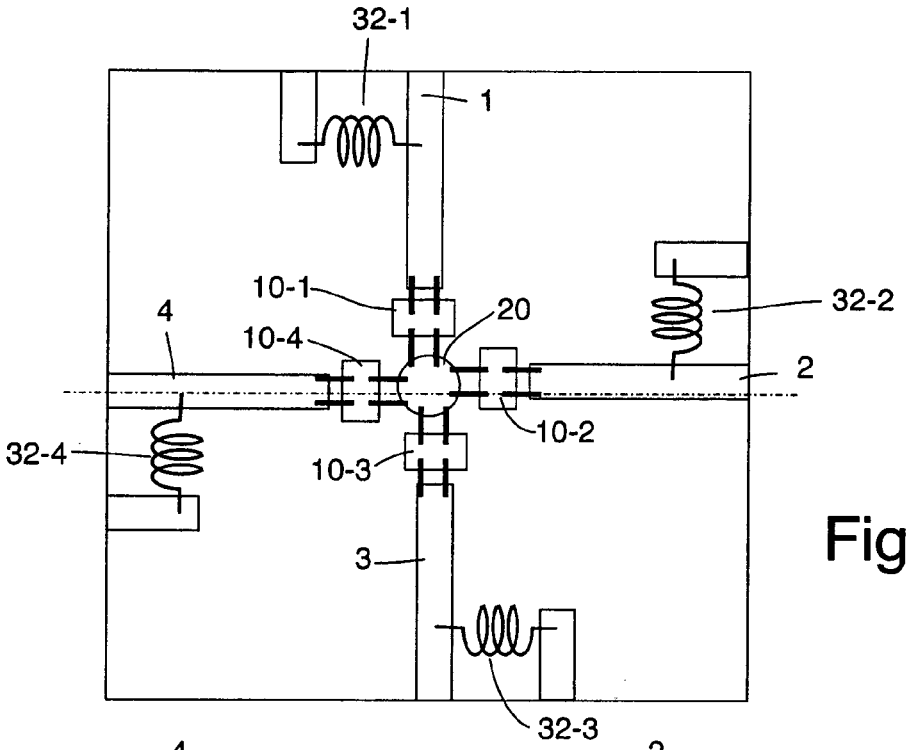
FIGS. 6*a* and 6*b* are top and side elevation views of still another embodiment of the present invention.
Figure 6B:
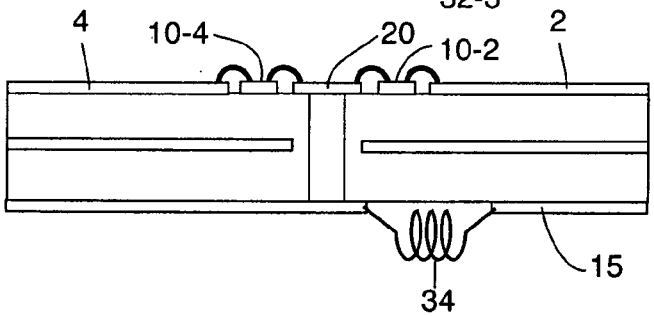

It should be understood that the operation of the disclosed device is reciprocal, in that the various ports described as the output ports could also serve as a plurality of alternate input ports which are fed to a common output port which is the central point 7. Furthermore, it should be understood that although 1×4 switching circuits have been shown, other numbers of switches in the switching circuits are possible such as 1×6 and 1×8 and possibly even higher numbers, and that these designs will be apparent to one skilled in the art of RF design after fully understanding the disclosure of this patent document. However, a large number of ports may be difficult to realize due to crowding of the RF lines and he DC bias lines. This issue can be addressed by using the modification shown in FIGS. 6*a* and 6*b*. In this embodiment, the RF and DC signals share lines 1, 2, 3, 4. Both the RF and the DC ports of the MEMS switches 10-1 . . . 10-4 are connected together, as shown in FIG. 6*a*. The DC portion of the signal may be separated from the RF portion by using an inductor 32-1 . . . 32-4 in each of the switches' DC circuit. This may be either a lumped element, a printed inductor, or an inductive structure such as a very high-impedance RF line. Another inductor 34 may be needed to separate the RF signal from the DC ground as shown in FIG. 6*b*. In that case, the end of inductor 34 remote from the connection to via 20 is coupled to a line 15 at ground potential. If it is necessary to prevent the DC signal from reaching other RF components, then an external DC blocking capacitor may be used on each of the RF lines. These capacitors are not shown in the figures. FIGS. 6*a* and 6*b* show a four port arrangement, but it is to be understood that this modification would be more apt to be used where space constraints do not allow the other embodiments to be easily utilized.

Figure 7:
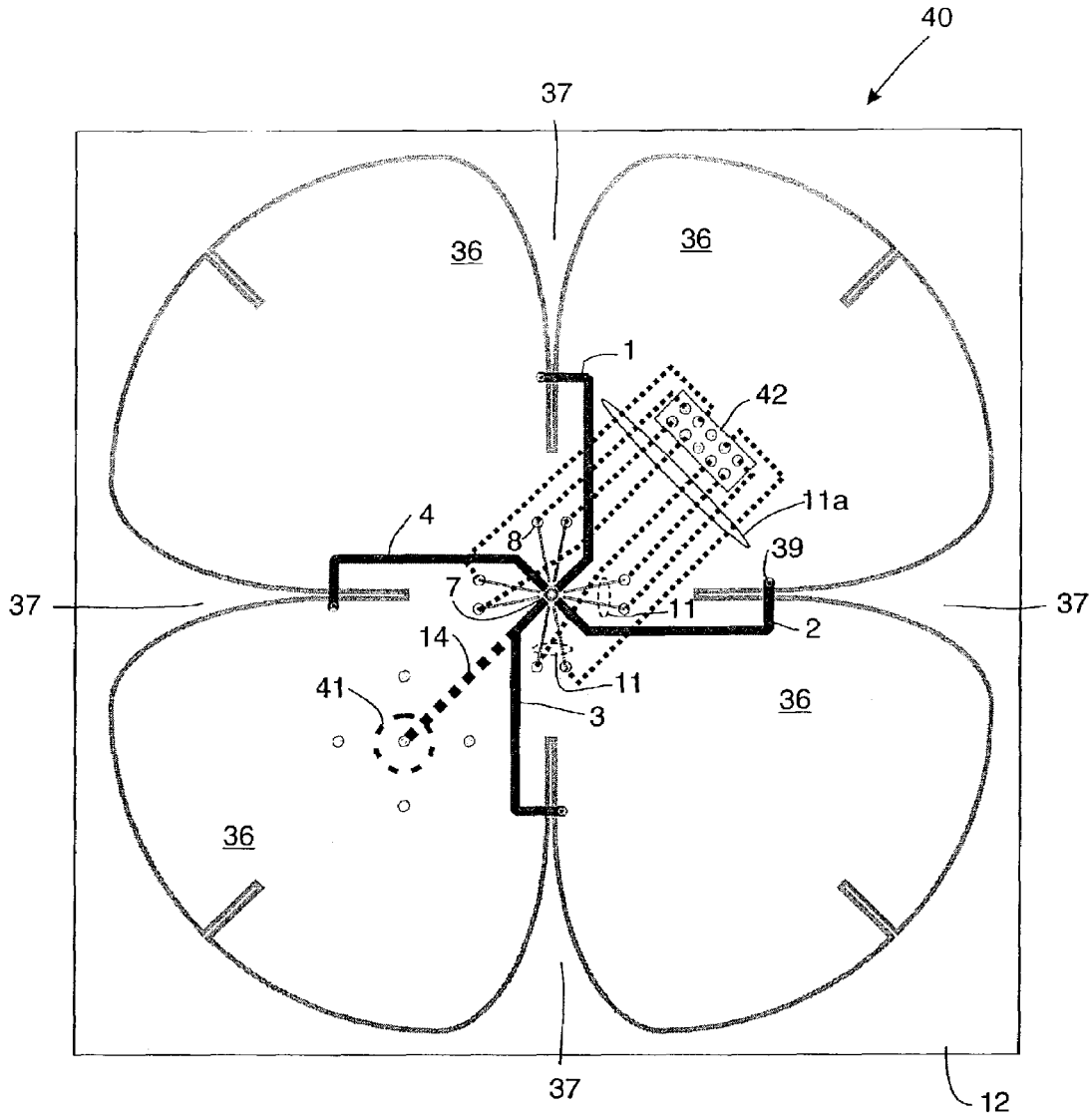
FIG. 7 depicts a switching arrangement of FIGS. 5*a* and 5*b* used in combination with a flared notch antenna.

In another aspect of this invention, the radial switching structure described above is combined with a printed antenna structure which may or may not share the same substrate 12. In the embodiment of FIG. 7, the printed antenna structure 40 preferably includes four conductive cloverleaf elements 36 which define flared notch antennas 37 therebetween. The DC bias lines 11*a* disposed on the back side of the board, as well as the common RF line 14, also on the backside of the board, are shown in dashed lines. The selectable RF lines on the front side of the board are shown in solid lines. The conductive cloverleaf elements are preferably formed on one surface of board 12 using conventional printed circuit board fabrication techniques. Thus, the cloverleaf elements 36 may be made by appropriately etching a copper-clad printed circuit board, for example. The lines on the bottom side (shown dashed) can be similarly made by appropriately etching a copper-clad printed circuit board.

Each flared notch 37 is fed by a separate microstrip line 1-4, each of which crosses over the notch of an antenna and is shorted to the ground plane 18 (see, e.g., FIG. 5*b*) on the opposite side of board 12 at vias 39. These microstrip lines correspond to the similarly numbered ports 1-4 discussed with respect to the switch arrangements of the earlier mentioned figures. RE energy passing down these microstrip lines is radiated from the associated antenna structure in a direction that antenna is pointing (i.e. along the mid-points of the notch of the notch antenna which is excited). The DC bias lines 11 and 11*a* are preferably routed to a common connector 42 on the bottom side of the board 12 and the RF input preferably comprises a single feed point 41 which is routed to one of the four antenna structures (by means of one of the microstrips 1-4) as determined by which MEMS switch 10 (see FIG. 5*a* the switches 10 are too small to be shown clearly on FIG. 7, but they are clustered around point 7) is closed. Bias lines 11 are disposed on the top side of board 12 while bias lines 11*a* are disposed on the bottom side thereof. They are coupled together through the board 12 by means of vias. A pad 8 of one via is numbered in FIG. 7 (the other vias are unnumbered due to the limited space available around them for reference numerals, but the vias can, nevertheless, be easily seen). The vias in FIG. 7 are shown spaced further from the center point 7 than they would be in an actual embodiment, merely for ease of illustration.

Figure 8:
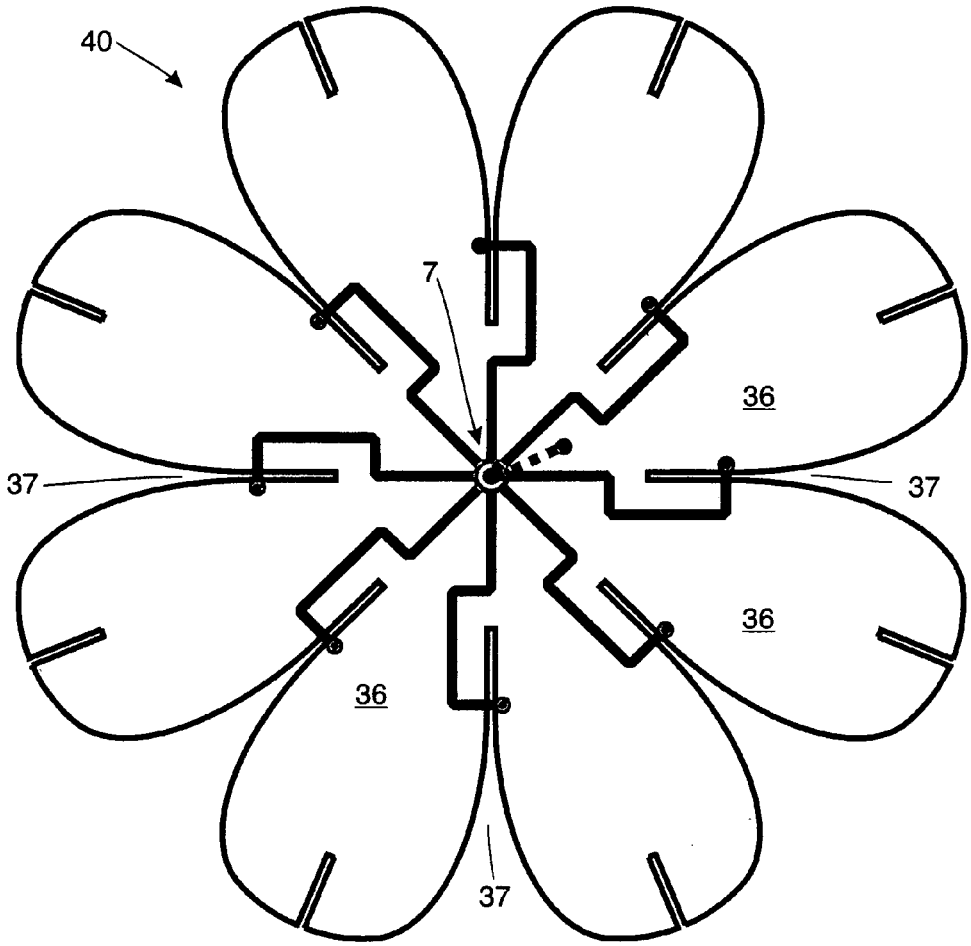
FIG. 8 depicts a switching arrangement of FIGS. 5*a* and 5*b* used in combination with a flared notch antenna having eight flared notch elements.

An embodiment more complicated than that of FIG. 7 is shown in FIG. 8. This embodiment has eight flared notches 37 defined by cloverleaf elements 36 and a single 1×8 array of RF MEMS switches 10 at the central point 7 (see FIG. 5*a*—the switches 10 are again too small to be shown easily on FIG. 8, but they are nevertheless clustered around central point 7). This antenna uses the 1×8 MEMS switch to route the common input port to one of eight flared notch antennas 37. This drawing only shows the general concept of the structure and does not show the required DC bias lines or inductors. But those bias lines would be similar to those shown in FIG. 7, but more numerous given the fact that this embodiment has eight notches 37 rather than four notches 37.

FIGS. 7 and 8 demonstrate that the matrix of single-pole, multi-throw MEMS switches can be combined with an antenna structure 40 to create a switched beam diversity antenna of rather inexpensive components. The structure shown by FIG. 7 uses four flared notches 37, which are addressed by a 1×4 MEMS switch matrix preferably arranged in the radial configuration described above.

The preferred embodiment of the hybrid single-pole, multi-throw switch has been described with reference to FIGS. 3*a* and 3*b*. It is felt that this embodiment can be rather easily manufactured. The antenna cloverleaf design of FIG. 8 is preferred since eight slots provide good diversity control. However, there may be other embodiments, and other ways of solving the problems associated with the candidate structure described with reference to FIG. 1. One such solution is shown in FIG. 9.

Figure 9:
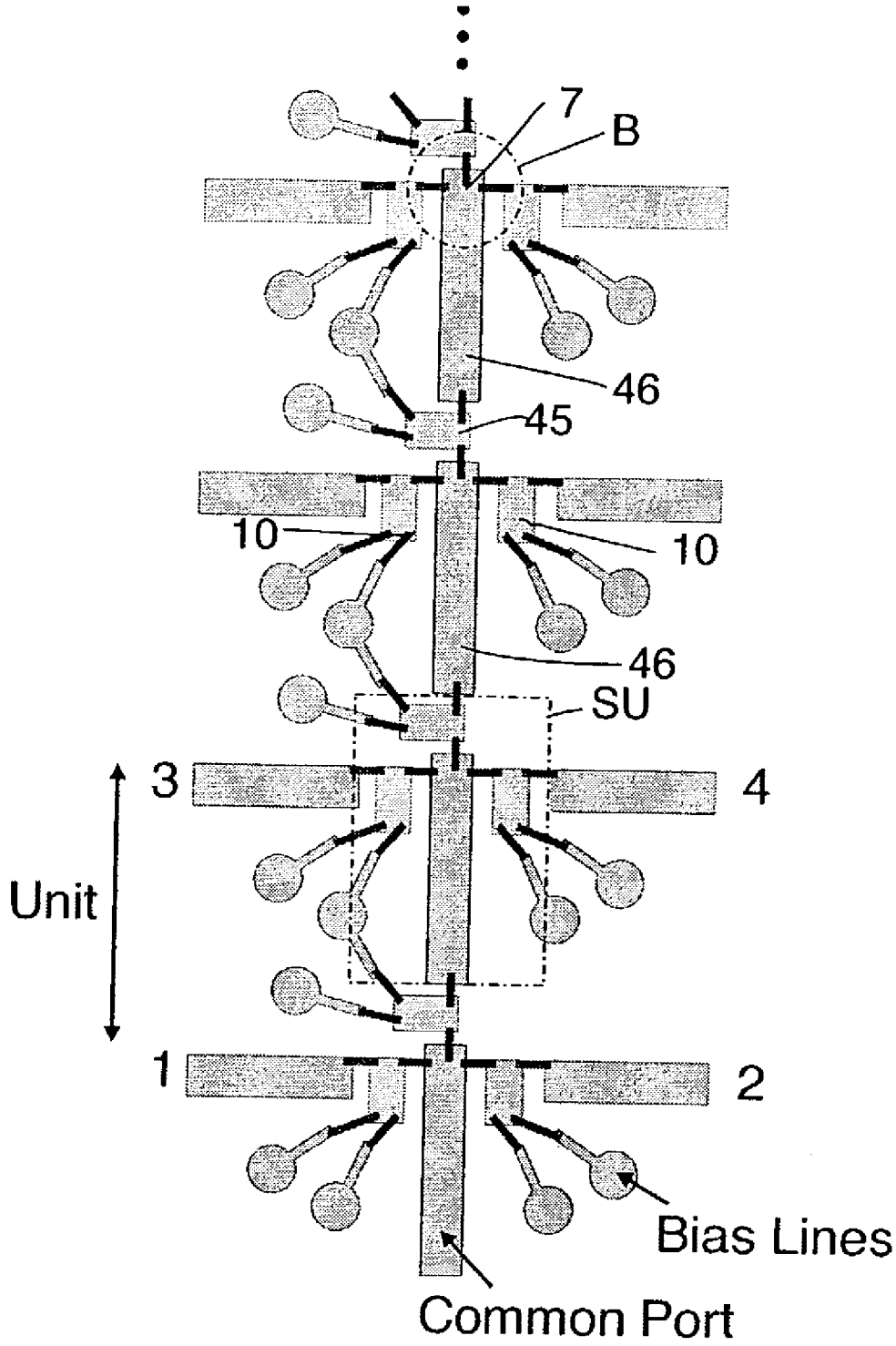
FIG. 9 depicts another improvement compared to the switch of FIG. 1.

The embodiment of FIG. 9 is not a presently preferred embodiment of this invention, but it is an embodiment that may have sufficient advantages in certain applications, such as when metal plated vias cannot be used, that some practicing the present invention may choose to utilize it. This may be the case when a monolithic approach is taken, when vias and internal ground layers may not be feasible or may not be simple to realize. This embodiment builds on the concept that the individual MEMS devices 10 are preferably clustered as closely as possible around a central point 7 to avoid parasitic reactance. This embodiment also recognizes that this may not be possible for a design to have a large number of ports, because when the microstrip transmission lines are brought too close to each other, unwanted coupling occurs. To address both of these problems, a 1×3 switching unit SU is used as a building block for a 1×N switch of any desired size. Each SU has a pair of MEMS switches 10 for coupling the transmission lines to a central point 7 of the SU. Each transmission line port 1, 2 of a first unit is accessed through a MEMS device 10, while subsequent transmission line ports (for example, ports 3, 4 of a second SU) are accessed through one or more third MEMS device(s) 45 which route the RF signals along sections of central transmission line 46 (which may now be of any length required to minimize coupling between ports) to a next 1×3 switching unit SU. Each switching unit SU comprises two (or possibly more) MEMS switches 10 clustered around its own central point 7 for coupling the transmission lines thereto and another MEMS switch 45 for passing the incoming signal to yet another switching unit SU. In this and in each subsequent block SU, two additional (or more) transmission lines may be addressed each through their own individual MEMS device 10, or the signals may be sent to the next SU through the third MEMS device 45. Since unused sections of transmission line are switched off when they are not used, they do not present unwanted parasitic reactance. Of course, all of the DC bias methods described in previous embodiments may be applied to this structure as well. Furthermore, other structures that use the 1×3 building block in this way, to allow necessary but unwanted sections of transmission lines to be turned off when not in use, will be apparent after this invention is understood. One example of another design would be a corporate switching structure, as opposed to the linear one presented here. In a corporate structure one input feeds two outputs, each of which in turn feed two more outputs, and those outputs each in turn feed two more outputs, until you have $2^n$ outputs at the end. When it is drawn, it looks like a corporate organization chart with many layers of middle management (hence the name).

FIG. 9 thus depicts an alternate design that may be used if a central metal-plated via 20 feature of the earlier embodiments is not feasible. The design of FIG. 9 uses a 1×3 switch SU as a building block for a 1×N switch of any size. It benefits from the knowledge that dangling sections of RF line will cause parasitic reactance when they are not used. In each 1×3 unit SU, the third switch 45 is opened if one of the ports on that unit is selected by means of closing its associated MEMS switch 10. If neither switch 10 is selected, the third switch 45 is closed, and the signal is routed to the next SU. By using this geometry, the sections of RF line between units can be as long as is needed to minimize coupling between the selectable ports, because those sections of RF line are switched off when not in use. Of course, this building-block approach can be used to make any geometry of 1×N switch.

The MEMS switches 10 are preferably disposed in a circular arrangement around central point 7. Note that in this embodiment the switches 10, 45 also preferably lie on an imaginary circle, here again identified by the letter B. Note also that the switches 10, 45 and segment 46 are preferably arranged equidistant ly along the circumference identified by the letter B.

In the numbering of the elements in this description and in the drawings, numbers such as 10-2 appear. The first portion (the 10 in this case) refers to the element type (a MEMS switch in this case) and the second portion (the 2 in this case) refer to a particular one of those elements (a second MEMS switch 10 in this case). This numbering scheme is likely self-explanatory, but it is nevertheless here explained for the reader who might not have previously encountered it.

The MEM switches 10-1 . . . 10-4 and 45 may be provided with integral impedance matching elements, such as capacitors, in order to increase the return loss to more than 20 dB. For that reason, the MEM switches disclosed by U.S. Provisional Patent Application Ser. No. 60/470,026 filed May 12, 2003 and entitled "RF MEMS Switch with Integrated Impedance Matching Structure" are believed to be the preferred MEM switches for use in connection with this invention.

Having described the invention in connection with certain embodiments thereof, modification will now certainly suggest itself to those skilled in the art. A such, the invention is not to be limited to the disclosed embodiments except as required by the appended claims.

What is claimed is:

1. A switch arrangement comprising:

(a) a plurality of MEMS switches arranged on a substrate about an axis through said substrate, each MEMS switch being disposed on a common imaginary circle centered on said axis, and each MEMS switch being spaced equidistantly along the circumference of said imaginary circle;

(b) a conductive via in said substrate arranged parallel to and on said axis; and (c) connections for connecting a RF port of each one of said plurality of MEMS switches with said conductive via.

2. The switch arrangement of claim 1 wherein the substrate has a ground plane therein, said conductive via passing through said ground plane without contacting said ground plane.

3. The switch arrangement of claim 2 further including a plurality of strip lines, each one of said plurality of strip lines being coupled to a RF contact of one of said plurality of MEMS switches.

4. The switch arrangement of claim 3 wherein said plurality of strip lines are radially arranged relative to said axis.

5. The switch arrangement of claim 4 wherein said plurality of strip lines and said plurality of MEMS switches are disposed on a first major surface of said substrate.

6. The switch arrangement of claim 5 further including a plurality of control lines disposed on said first major surface of said substrate, each control line being coupled to an associated one of said plurality of MEMS switches and being disposed between two adjacent strip lines.

7. The switch arrangement of claim 6 wherein each of the plurality of control lines has a first width and wherein each of the plurality of strip lines has a second width, the second width being at least three times greater than the first width.

8. The switch arrangement of claim 6 further including a plurality of conductive vias in said substrate arranged parallel to said axis and contacting said ground plane, each of said plurality of MEMS switches having a DC ground contact which is wired to one of the plurality of conductive vias contacting said ground plane.

9. The switch arrangement of claim 8 further including an impedance device coupling the conductive via on the central point to one of the plurality of conductive vias, the impedance device being disposed adjacent a second major surface of said substrate.

10. The switch arrangement of claim 5 further including a plurality of control lines arranged in pairs and disposed on said first major surface of said substrate, each control line pair being coupled to an associated one of said plurality of MEMS switches and being disposed between two adjacent strip lines.

11. The switch arrangement of claim 10 wherein each of the plurality of control lines has a first width and wherein each of the plurality of strip lines has a second width, the second width being at least three times greater than the first width.

12. A switch arrangement comprising a plurality of switch units, each switch unit having at least two MEMS switches coupled to a first central point, the at least two MEMS switches of the switch unit being arranged to couple selectively at least two co-linear transmission line ports to said first central point, and at least a third MEMS switch coupled to said first central point and adapted to be connected to a second central point different from said first central point, said second central point associated with an adjacent one of said plurality of switch units.

13. The switch arrangement of claim 12 wherein each switch unit has a centrally disposed transmission line, the centrally disposed transmission line connecting the switch unit to the at least a third MEMS switch associated with an adjacent one of said plurality of switch units.

14. The switch arrangement of claim 13 wherein the centrally disposed transmission line is linearly arranged from a central point of each switch unit towards the at least a third MEMS switch associated with an adjacent one of said plurality of switch units.

15. The switch arrangement of claim 12 wherein the at least two transmission line ports are arranged to couple antennas to said at least two MEMS switches.

16. A switch arrangement comprising:

(a) a plurality of MEMS switches arranged on a substrate about a central point, each MEMS switch being disposed on a common imaginary circle centered on said central point, and each MEMS switch being spaced equidistantly along the circumference of said imaginary circle; and (b) connections for connecting a RE port of each one of said MEMS switches with said central point, wherein at least two of the MEMS switches are arranged to couple selectively at least two transmission lines to said central point and wherein a pair of the at least two transmission lines are disposed co-linearly of each other.

17. The switch arrangement of claim 16 wherein at least one of the MEMS switches is arranged to couple selectively the central point of the switch arrangement to a central point associated with another switch arrangement via a transmission line segment.

18. The switch arrangement of claim 16 wherein the substrate has a ground plane therein and the switch arrangement further includes a conductive via in said substrate arranged parallel to and on a vertical axis which is normal to a major surface of substrate and which passes through said central point, the conductive via passing through said ground plane without contacting same.

19. The switch arrangement of claim 18 further including a plurality of strip lines, each one of said plurality of strip lines being coupled to a RF contact of one of said plurality of MEMS switches.

20. The switch arrangement of claim 19 wherein said plurality of strip lines are radially arranged relative to said central point.

21. The switch arrangement of claim 20 wherein said plurality of strip lines and said plurality of MEMS switches are disposed on a first major surface of said substrate.

22. The switch arrangement of claim 21 further including a plurality of control lines disposed on said first major surface of said substrate, each control line being coupled to an associated one of said plurality of MIEMS switches and being disposed between two adjacent strip lines of said plurality of strip lines.

23. The switch arrangement of claim 22 further including a plurality of conductive vias in said substrate arranged parallel to said axis and contacting said ground plane, each of said plurality of MEMS switches having a DC ground contact which is wired to a one of a plurality of conductive vias contacting said ground plane.

24. The switch arrangement of claim 23 further including an impedance device coupling a conductive via on the central point to one of the plurality of conductive vias, the impedance device being disposed adjacent a second major surface of said substrate.

25. The switch arrangement of claim 21 further including a plurality of control lines arranged in pairs and disposed on said first major surface of said substrate, each control line pair being coupled to an associated one of said plurality of MEMS switches and being disposed between two adjacent strip lines of said plurality of strip lines.

26. An antenna comprising a plurality of end fire Vivaldi antennas arranged in a cloverleaf configuration in combination with the switch arrangement of claim 16 for controlling which one or ones of said plurality of end fire Vivaldi antennas is or are active.

27. An antenna comprising a plurality of end fire Vivaldi antennas arranged in a cloverleaf configuration in combination with the switch arrangement of claim 16 for controlling which one of said plurality of end fire Vivaldi antennas is active.

28. A method of making a switch arrangement comprising:

(a) disposing a plurality of MEMS switches on a substrate in a circular pattern about a point;

(b) disposing a plurality of RE lines disposed in a radial pattern relative to said point on said substrate; and (c) connecting said plurality of RE lines to a common junction point at said point on said substrate via said plurality of MEMS switches whereby operation of a one of said plurality of MEMS switches couples a one of said plurality of RF lines to said common junction, wherein at least two of the MEMS switches of said plurality of MEMS switches are arranged to couple selectively at least two RE lines to said point and wherein a pair of the at least two RF lines are disposed co-linearly of each other.

29. The method of claim 28 wherein at least one of the MEMS switches of said plurality of MEMS switches is arranged to couple selectively the common junction point to another common junction point associated with another switch arrangement made according to the method of claim 28 via a transmission line segment disposed on said substrate.

30. The method of claim 29 further including providing a ground plane in the substrate and providing a conductive via in said substrate arranged parallel to and on an axis through said point and normal to a major surface of said substrate, the conductive via passing through said ground plane without contacting same.

31. The method of claim 30 further including disposing a plurality of strip lines on said surface and coupling each one of said plurality of strip lines to a RF contact of one of said plurality of MEMS switches.

32. The method of claim 31 wherein said plurality of strip line and said plurality of MEMS switches are disposed on the first major surface of said substrate.

33. The method of claim 32 further including disposing a plurality of control lines on the first major surface of said substrate, each control line being coupled to an associated one of said plurality of MEMS switches and being disposed between two adjacent strip lines.

34. The method of claim 33 further including providing a plurality of conductive vias in said substrate arranged parallel to said axis and contacting said ground plane, each of said plurality of MEMS switches having a DC ground contact which is wired to a one of the plurality of conductive vias contacting said ground plane.

35. The method of claim 34 further including coupling an impedance device between (i) the conductive via connected to the common junction point and (ii) at least one of the plurality of conductive vias, the impedance device being disposed adjacent a second major surface of said substrate.

36. The method of claim 32 further including disposing a plurality of control lines arranged in pairs on the first major surface of said substrate, each control line pair being coupled to an associated one of said plurality of MEMS switches and being disposed between two adjacent strip lines.

37. A switch arrangement comprising:

(a) a plurality of MEMS switches arranged on a substrate about a common RE port, the RE port having a centerline and each MEMS switch being disposed spaced equidistantly from the centerline of said RE port; and (b) connections for connecting a RE contact of each one of said MEMS switches with said common RE port, wherein at least two of the MEMS switches of said plurality of MEMS switches are arranged to couple selectively at least two RE lines to said RE port and wherein a pair of the at least two RE lines are disposed co-linearly of each other.

38. The switch arrangement of claim 37 wherein the centerline of the RE port is disposed perpendicular to a major surface of said substrate.

39. The switch arrangement of claim 37 wherein the centerline of the RE port is disposed parallel to a major surface of said substrate.

* * * * *